United States Patent [19]

Deutsch

[11] Patent Number: 4,549,459

[45] Date of Patent: Oct. 29, 1985

[54] INTEGRAL AND A DIFFERENTIAL WAVESHAPE GENERATOR FOR AN ELECTRONIC MUSICAL INSTRUMENT

[75] Inventor: Ralph Deutsch, Sherman Oaks, Calif.

[73] Assignee: Kawai Musical Instrument Mfg. Co., Ltd., Hamamatsu, Japan

[21] Appl. No.: 597,316

[22] Filed: Apr. 6, 1984

[51] Int. Cl.[4] ..... G10H 1/06; G10H 7/00

[52] U.S. Cl. ..... 84/1.01; 84/1.19; 84/1.22

[58] Field of Search ..... 84/1.01, 1.19, 1.22

[56] References Cited

U.S. PATENT DOCUMENTS

| | | | |
|---|---|---|---|
| 4,079,650 | 3/1978 | Deutsch et al. | 84/1.01 X |
| 4,135,422 | 1/1979 | Chibana | 84/1.01 |
| 4,238,984 | 12/1980 | Watanabe | 84/1.01 |
| 4,254,681 | 3/1981 | Kugisawa | 84/1.01 |
| 4,269,101 | 5/1981 | Deutsch et al. | 84/1.01 |
| 4,344,343 | 8/1982 | Deforeit | 84/1.01 |
| 4,387,622 | 6/1983 | Deutsch | 84/1.22 |
| 4,398,442 | 8/1983 | Deutsch | 84/1.01 X |

*Primary Examiner*—Stanley J. Witkowski

*Attorney, Agent, or Firm*—Ralph Deutsch

[57] ABSTRACT

A keyboard operated electronic musical instrument is disclosed which has a number of tone generators that are assigned to actuated keyswitches. Musical tones are produced by computing a master data set which defines the data points for a period of the musical waveshape. The computation uses a preselected set of harmonic coefficients. Provision is made for altering the harmonic coefficients to produce waveshapes which are derivatives or integrals of the basic waveshape. The order of differentiation or integration can be varied to produce time variant tone effects.

11 Claims, 9 Drawing Figures

INTEGRAL AND A DIFFERENTIAL WAVESHAPE GENERATOR FOR AN ELECTRONIC MUSICAL INSTRUMENT

BACKGROUND OF THE INVENTION

1. Field of the Invention

This invention relates to electronic music synthesis and in particular is concerned with generating waveshapes having points which are derivatives or integrals of prespecified musical waveshapes.

2. Description of the Prior Art

Musical tone synthesizers of the type in which a waveshape rich in harmonics is passed through a sliding formant filter to produce a time-varying tonal effect by altering the strength of the harmonics are well known in the musical tone generation art. In analog signal tone synthesizers, the sliding formant filter is generally implemented as a high pass or a low pass filter in which the cutoff frequency may be varied with time to alter the harmonic content of the musical waveshape at the output of the filter. In digital tone generation systems the equivalent effect of a sliding formant filter can be achieved by scaling the harmonic coefficients that are used in a computational algorithm to obtain the successive amplitude point values of the musical waveshape. Digital musical systems of this type are described in U.S. Pat. No. 3,956,960 entitled "Formant Filtering In A Computor Organ" and in U.S. Pat. No. 4,085,644 entitled "Polyphonic Tone Synthesizer."

In U.S. Pat. No. 4 281,574 an arrangement is described for a digital musical tone generation system which achieves a time-varying harmonic structure for a digital musical waveshape. Each amplitude point of the waveshape is modified by adding or subtracting a prior amplitude point. The delay time between the points can be varied so that any one of a number of prior data points can be selected for addition or subtraction with the current amplitude point. A source of sequential data representing changes in amplitude of the musical waveshape as a function of time are connected to a varialbe delay means, such as a shift register, which provides temporary storage of a group of sequential data points on a first-in, first-out basis. Any one of the data points stored in the shift register can be selected as one input to a subtract or add circuit together with the current data point from the source. Each resultant value is then applied to a digital-to-analog converter to provide an audio output signal.

A system related to the U.S. Pat. No. 4,281,574 is described in the technical article:

Kevin Karplus and Alex Strong, "Digital Synthesis of Plucked-String and Drum Timbres." *Computer Music Journal,* published by the MIT Press, Cambridge Mass., Vol. 7, No. 2, Summer 1983, pp 43–69.

In this article a basic tone modification system is described in which a new waveshape point is obtained by averaging two successive waveshape sample points. The difference of two successive points is also proposed as a method of changing the spectral content of a digital waveshape.

Both the system described in the referenced U.S. Pat. No. 4,281,574 and the technical article are related to a procedure of waveshape modification somewhat resembling successive integration or differentiation of a musical wavehshape.

SUMMARY OF THE INVENTION

In a Polyphonic Tone Synthesizer of the type described in U.S. Pat. No. 4,085,644 a computation cycle and a data transfer cycle are repetitively and independently implemented to provide data which are converted into musical waveshapes. A sequence of computation cycles is implemented during each of which a master data set is created. The master data set comprises a set of data points which define a period of a musical waveshape.

The master data set is computed using a set of stored harmonic coefficients. A subsystem is used to transform these harmonic coefficients to harmonic coefficients that define a differential of the unmodified waveshape having a preselected order of differentiation. Alternatively the subsystem can be used to transform the harmonic coefficients to harmonic coefficients that define an integral of the unmodified waveshape having a preselected order of integration.

The order of differentiation or integration can have fractional values and can be made a time varying number. A method is described which maintains a constant power level for the musical waveshape which is maintained as the order of differentiation or integration is varied.

BRIEF DESCRIPTION OF THE DRAWINGS

The detailed description of the invention is made with reference to the accompanying drawings wherein like numerals designate like components in the figures.

DETAILED DESCRIPTION OF THE INVENTION

The present invention is directed toward a polyphonic tone synthesizer wherein waveshapes are created which are either integrals or differentials of a preselected waveshape. The tone modification system is incorporated into a musical instrument of the type which synthesizes musical waveshapes by implementing a discrete Fourier transform algorithm. A tone generation system of this variety is described in detail in U.S. Pat. No. 4,085,644 entitled "Polyphonic Tone Synthesizer." This patent is hereby incorporated by reference. In the following description all elements of the system which are described in the referenced patent are identified by two digit numbers which correspond to the same numbered elements appearing in the referenced patent.

Figure 1:
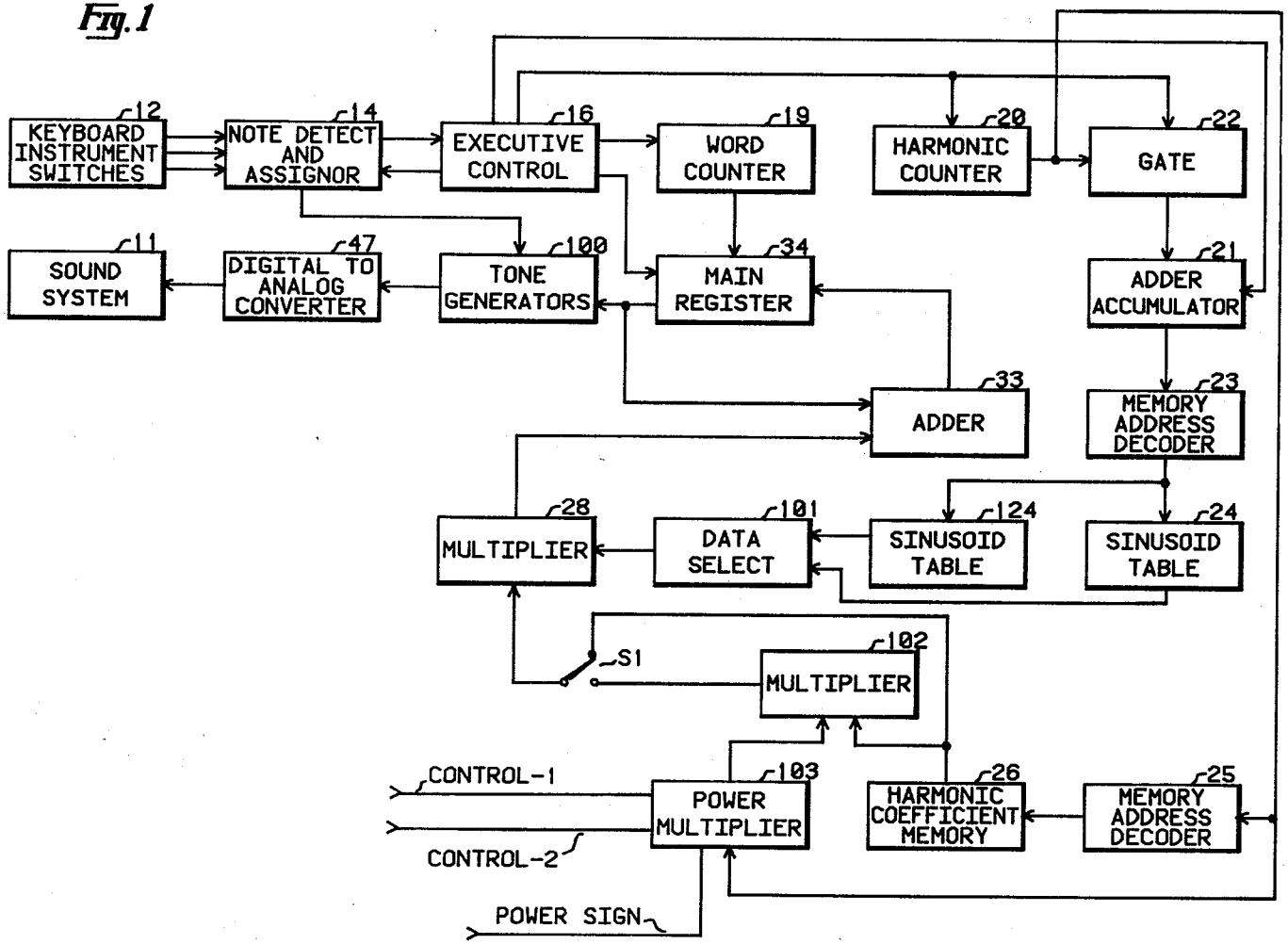
FIG. 1 is a schematic diagram of an embodiment of the invention.

FIG. 1 shows an embodiment of the present invention which is described as a modification and adjunct to the system described in U.S. Pat. No. 4,085,644. As described in the referenced patent, the Polyphonic Tone Synthesizer includes an array of keyboard instrument switches 12. If one or more of the keyboard switches has a switch status change and is actuated ("on" switch position), the note detect and assignor 14 encodes the detected keyboard switch having the status change to an actuated state and stores the corresponding note information for the actuated keyswitches. One member of the set of tone generators, contained in the system block labeled tone generators 100, is assigned to each actuated keyswitch using the information generated by the note detect and assignor 14.

A suitable note detect and assignor subsystem is described in U.S. Pat. No. 4,022,098 which is hereby incorporated by reference.

When one or more keyswitches have been actuated, the executive control 16 initiates a repetitive sequence of computation cycles. During each computation cycle, a master data set is computed. The 64 data words in a master data set correspond to the amplitudes of 64 equally spaced points of one cycle of the audio waveform for the musical tone produced by a corresponding one of the tone generators 100. The general rule is that the maximum number of harmonics in the audio tone spectra is no more than one-half of the number of data points in one complete waveshape period. Therefore, a master data set comprising 64 data words corresponds to a musical waveshape having a maximum of 32 harmonics.

As described in the referenced U.S. Pat. No. 4,085,644 it is desirable to be able to continuously recompute and store the generated master data sets during a repetitive sequence of computation cycles and to load this data into the note registers which are associated with each one of the tone generators in the block labeled tone generators 100 while the actuated keyswitches remain actuated, or depressed, on the keyboards.

In the manner described in the referenced U.S. Pat. No. 4,085,644 the harmonic counter 20 is initialized to its minimal, or zero, count state at the start of each computation cycle. Each time that the word counter 19 is incremented by the executive control 16 so that it returns to its initial, or minimal, count state because of its modulo counting implementation, a signal is generated by the executive control 16 which increments the count state of the harmonic counter 20. The word counter 19 is implemented to count modulo 64 which is the number of data words comprising the master data set. The harmonic counter 20 is implemented to count modulo 32. This number corresponds to the maximum number of harmonics consistent with a master data set comprising 64 data words.

At the start of each computation cycle, the accumulator in the adder-accumulator 21 is initialized to a zero value by the executive control 16. Each time that the word counter is incremented, the adder-accumulator 21 adds the current count state of the harmonic counter 20 to the sum contained in the accumulator. This addition is implemented to be modulo 64.

The content of the accumulator in the adder-accumulator 21 is used by the memory address decoder 23 to access trigonometric sinusoid values from the sinusoid table 24. The sinusoid table 24 is advantageously implemented as a read only memory storing values of the trigonometric function sin $(2\pi\phi/64)$ for $0 \leqq \phi \leqq 64$ at intervals of D. D is a table resolution constant.

The memory address decoder 23 also simultaneously reads out trigonometric values stored in the sinusoid table 124. The sinusoid table 124 can be implemented as a read only memory storing values of the trigonometric function cos $(2\pi\phi/64)$ for $0 \leqq \phi \leqq 64$ at intervals of D. An alternate implementation is to store the same values in sinusoid table 124 as are stored in the sinusoid table 24. The cosine values would then be obtained from the sine values stored in the table by offsetting the address furnished by the memory address decoder by an increment corresponding to ninety degrees.

If the logic state of the signal CONTROL-1 is a binary state "1", then the data select 101 will transfer a data value read out of the sinusoid table 24 to the multiplier 28. If CONTROL-1 has a "0" state, then the data select 101 will transfer a data value read out of the sinusoid table 124 to the multiplier 28.

The memory address decoder 25 reads out harmonic coefficients stored in the harmonic coefficient memory 26 in response to the count state of the harmonic counter 20. If S1 is actuated in its lower position, the harmonic coefficients read out of the harmonic coefficient memory 26 are furnished as one of the input data values to the multiplier 28. The product value formed by the multiplier 28 is furnished as one input to the adder 33.

The contents of the main register 34 are initialized to a zero value at the start of a computation cycle. Each time that the word counter 19 is incremented, the content of the main register 34, at an address corresponding to the count state of the word counter 19, is read out and furnished as an input to the adder 33. The sum of the inputs to the adder 33 are stored in the main register 34 at a memory location equal, or corresponding, to the count state of the word counter 19. After the word counter 19 has been cycled for 32 complete cycles of 64 counts, the main register 34 will contain the master data set which comprises a complete period of a musical waveshape having a spectral function determined by the set of harmonic coefficients provided to the multiplier 28.

Following each computation cycle in the repetitive sequence of computation cycles, a transfer cycle is initiated and executed. During a transfer cycle, in a manner described in the referenced U.S. Pat. No. 4,085,644, the master data set stored in the main register 34 is transferred into the note registers which are a component of each of the tone generators contained in the system block labeled tone generators 100.

The master data set stored in each of the note registers is sequentially and repetitively read out in response to a note clock. The read out data is converted into an analog signal by means of the digital-to-analog converter 47. The resultant analog signal is transformed into an audible musical sound by means of the sound system 11. The sound system 11 contains a conventional amplifier and speaker combination for producing audible tones.

The power multiplier 103, in combination with the multiplier 102 modifies the harmonic coefficients read out of the harmonic coefficient memory 26 to produce a master data set which is either some preselected derivative or integral of the waveshape produced directly from the original harmonic coefficients. These derivative or integral waveshapes are called derived waveshapes. The corresponding musical tones are called derived musical tones.

According to the referenced U.S. Pat. No. 4,085,644 the master data set generated during a computation cycle and stored in the main register 34 contains a set of data values defined by the relation $$z_n = \sum_{q=1}^{N/2} c_q \sin(2\pi qn/N) \qquad \text{Eq. 1}$$

where n=1, . . . , N is the index number corresponding to the address at which the data point $z_n$ is stored in the main register 34. N=64 is the total number of data points in the master data set. q is an index denoting a harmonic number.

The first derivative with respect to the displacement index variable n of the expression for the master data set is $$z_n^{(1)} = \Sigma(2\pi q/N)\, c_q \cos(2\pi qn/N) \qquad \text{Eq. 2}$$

The second derivative is $$z_n^{(2)} = \Sigma -(2\pi q/N)^2\, c_q \sin(2\pi qn/N) \qquad \text{Eq. 3.}$$

The general k'th derivative can be written in the form $$z_n^{(k)} = [(k+1) \bmod 2]\Sigma(-1)^{k/2}(2\pi q/N)^k\, c_q \sin(2\pi qn/N) + (k \bmod 2)\, \Sigma(-1)^{(k-1)/2}(2\pi q/N)^k\, c_q \cos(2\pi qn/N) \qquad \text{Eq. 4.}$$

It is noted from the general expression Eq. 4 for the k'th derivative of the master data set points that the harmonic coefficients $c_q$ are multiplied by the harmonic number q raised to a power equal to the order of the derivative. Moreover, the derivative data points correspond to derivative waveforms which alternate between even and odd symmetries.

The first integral with respect to the displacement index variable n of the master data set points defined by Eq. 1 is $$Z_{n(1)} = \Sigma(-1)(2\pi q/N)^{-1}\, c_q \cos(2\pi qn/N) \qquad \text{Eq. 5}$$

Eq. 5 uses a notation in which the upper case letter $Z_n$ denotes an integral of the original waveshape sample point variable $z_n$ and the subscript number in the parentheses denotes the number of times the original waveshape has been integrated.

The second integral of the waveshape is $$Z_{n(2)} = \Sigma(-1)(2\pi q/N)^{-2}\, c_q \sin(2\pi qn/N) \qquad \text{Eq. 6.}$$

The general k'th integral of the original master data set data points can be written in the form $$Z_n(k) = [(k+1) \bmod 2]\Sigma(-1)^{-k/2}(2\pi q/N)^{-k} c_q \sin(2\pi qn/N) + (k \bmod 2)\Sigma(-1)^{(k-1)/2}(2\pi q/N)^{-k} c_q \cos(2\pi qn/N) \qquad \text{Eq. 7.}$$

It is noted from the general expression for the k'th integral of the master data set points that the harmonic coefficients $c_q$ are divided by the harmonic number q raised to a power equal to the order of the integration. Moreover, the integral data points correspond to integral waveforms which alternate between even and odd symmetries.

The summation limits for the summations in Eq. 2 to Eq. 7 are the same as those shown explicitly in Eq. 1.

The CONTROL-1 signal is used to determine if either a trigonometric sine value or a trigonometric cosine value is to be used by the multiplier 28 in computing the data point values which comprise the master data set. If the CONTROL-1 signal is in a binary logic state of "1" the data select 101 transfers the sine values read out of the sinusoid table 24 to the multiplier 28.

In response to the CONTROL-2 signal, the power multiplier 103 raises the numeric value of the content of the harmonic counter 20 to a power corresponding to the CONTROL-2 signal. Since the memory address decoder 25 produces an address corresponding to the count state of the harmonic counter 20, the address output of the memory address decoder 25 can also be used interchangeably with the count state of the harmonic counter 20.

Figure 2:
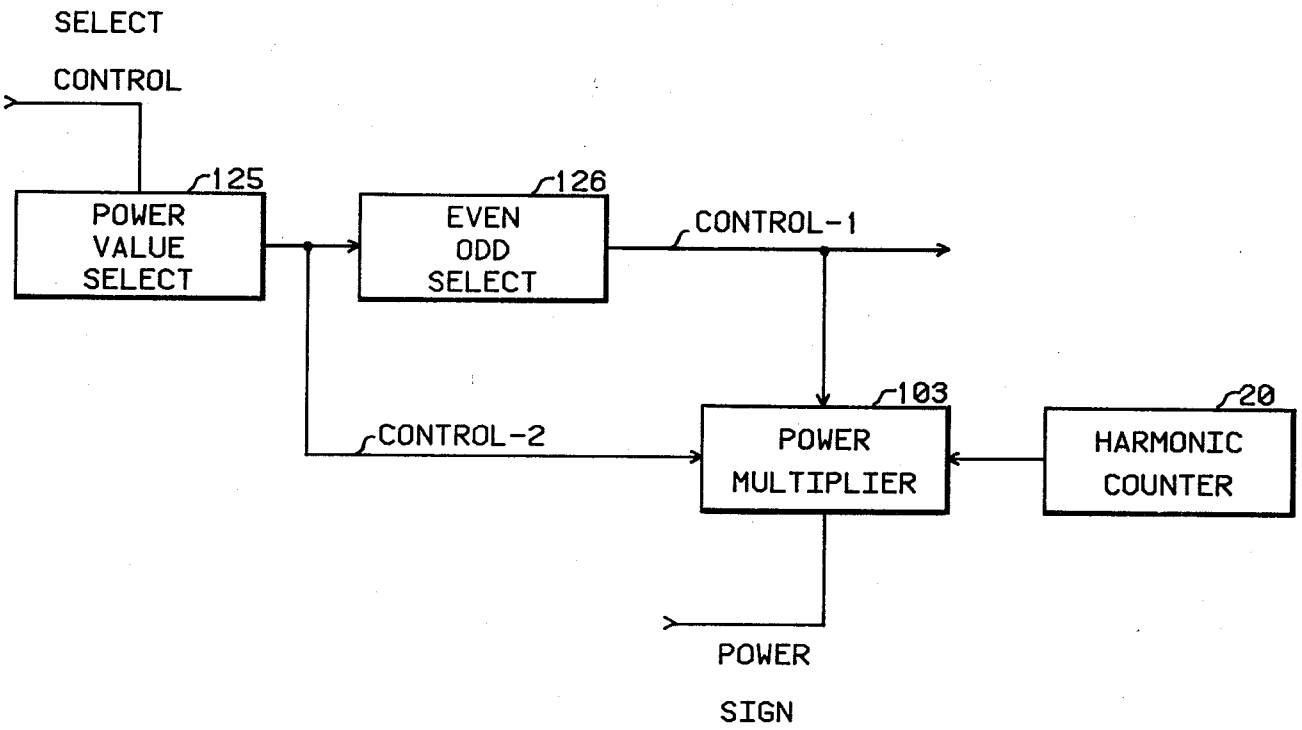
FIG. 2 is a schematic diagram of the control signal generator.

FIG. 2 illustrates apparatus for generating both the CONTROL-1 and the CONTROL-2 signals. The SELECT CONTROL signal is a signal whose value determines the order of differential or integration for the waveshape to be generated. The power value select 125 is used to convert the SELECT CONTROL to a binary data word. The power select 125 can be implemented as an analog-to-digital converter. An alternate implementation is to have a read only memory in which stored numbers are addressed out in response to the SELECT CONTROL signal. The output of the power value select 125 is the CONTROL-2 signal.

The even odd select 126 creates a "1" value for the CONTROL-1 signal if the CONTROL-2 signal has an odd numerical value. A simple implementation for the even odd select 126 is a gate which selects the least significant bit of the CONTROL-2 signal and complements this bit by means of an inverter gate.

The POWER SIGN signal supplied to the power multiplier is used to select between signal differentiation and signal integration. If the POWER SIGN signal has a "1" binary logic state then the power multiplier creates a positive numerical power of the state of the harmonic counter 20. This numerical power coefficient is equal to the value of the CONTROL-2 signal. Thus the power multiplier 103 will multiply the content of the harmonic counter 20 by itself a number of times which is equal to the value of the CONTROL-2 signal. If the POWER SIGN signal has a "0" binary logic state the power multiplier 103 will create the negative numerical power of the CONTROL-2 signal. In this case the power multiplier 103 will multiply the content of the harmonic counter 20 by itself a number of times equal to the value of the CONTROL-2 signal and then generate the reciprocal of the result. There are many methods for implementing the power multiplier 103 as a computing device. One such implementation is to use a microprocessor unit which is programmed to compute a specified numeric power of an input number as well as to divide a unit number by this power to form the reciprocal value.

Figure 3:
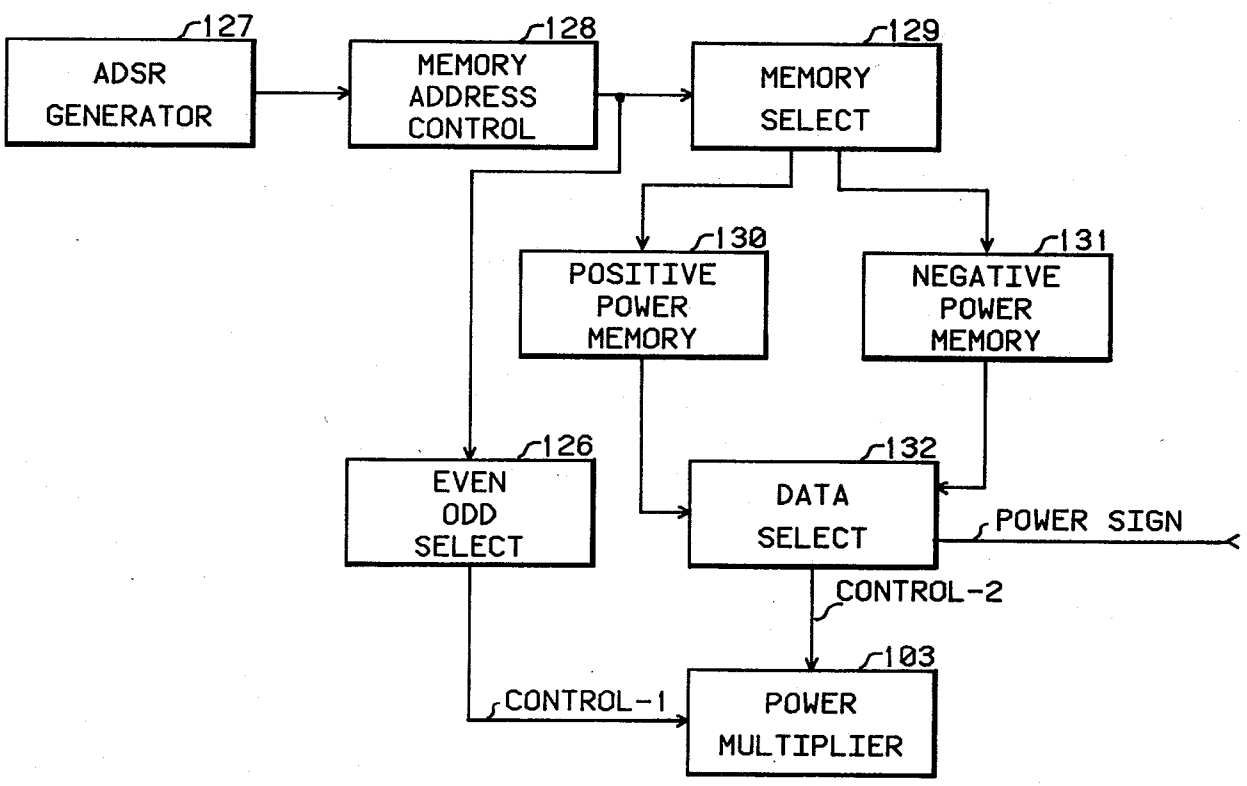
FIG. 3 is a schematic diagram for a control signal generator.

The SELECT CONTROL signal can be generated in any of a wide variety of known means to create signals. FIG. 3 illustrates a system for generating the SELECT CONTROL signal in a manner which causes the generated musical tones to have a spectra which varies in response to the instantaneous values of an ADSR (attack/decay/sustain/release) envelope function generator. The ADSR envelope values created by the ADSR generator 127 are furnished to the memory address control 128. The integer portion of the ADSR envelope value is transferred via the memory select 129 to access stored values from both the positive power memory 130 and the negative power memory 131.

The data select 132 in response to the POWER SIGN signal selects either the data values read out of the positive power memory 130 or the negative power memory 131 and transfers the selected values to the power multiplier 103. The values read out of the positive power memory 130 are selected if the POWER SIGN signal has a binary "1" logic state.

If data is selected from the positive power memory 130, the master data set will be computed to correspond to a differentiation of the waveshape data corresponding to the harmonic coefficients stored in the harmonic coefficient memory 26. If data is selected from the negative power memory 131, the master data set will be computed to correspond to a differentiation of the waveshape data corresponding to the harmonic coefficients stored in the harmonic coefficient memory 26. The positive power memory 131 stores the set of values 1,2, . . . ,N/2 while the negative power memory stores the set of values $-1,-2,-3,\ldots,-N/2$; where N is the number of points comprising the master data set.

The even odd select 126 generates a binary "1" for the CONTROL-1 signal if the least significant bit of the integer output from the memory address control 128 has a binary "0" value.

Apparatus for implementing the ADSR generator 127 is described in U.S. Pat. No. 4,079,650. This patent is hereby incorporated by reference.

Figure 4:
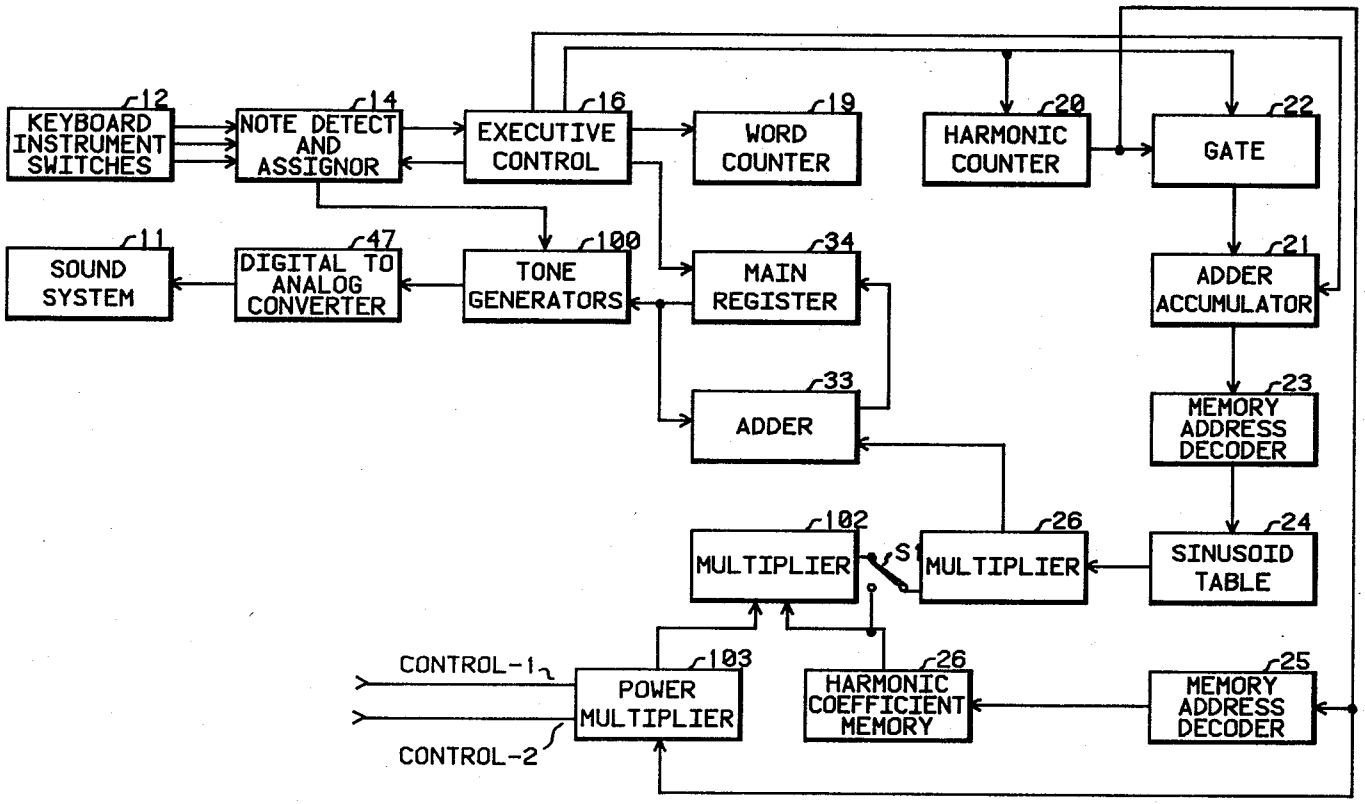
FIG. 4 is a schematic diagram of an alternate embodiment of the invention.

An alternative embodiment of the invention system is shown in FIG. 4. In this configuration a system implementation economy is attained by employing only a single sinusoid table. Since the human auditory senses are insensitive to signal phases of the individual Fourier components comprising a periodic waveshape, it is not necessary to alternate between trigonometric sine and cosine functions for the various order of integration and differentiation if the master data set computed and residing in the main register 34 is not combined with any other master data set values computed by some other subsystem.

Figure 5:
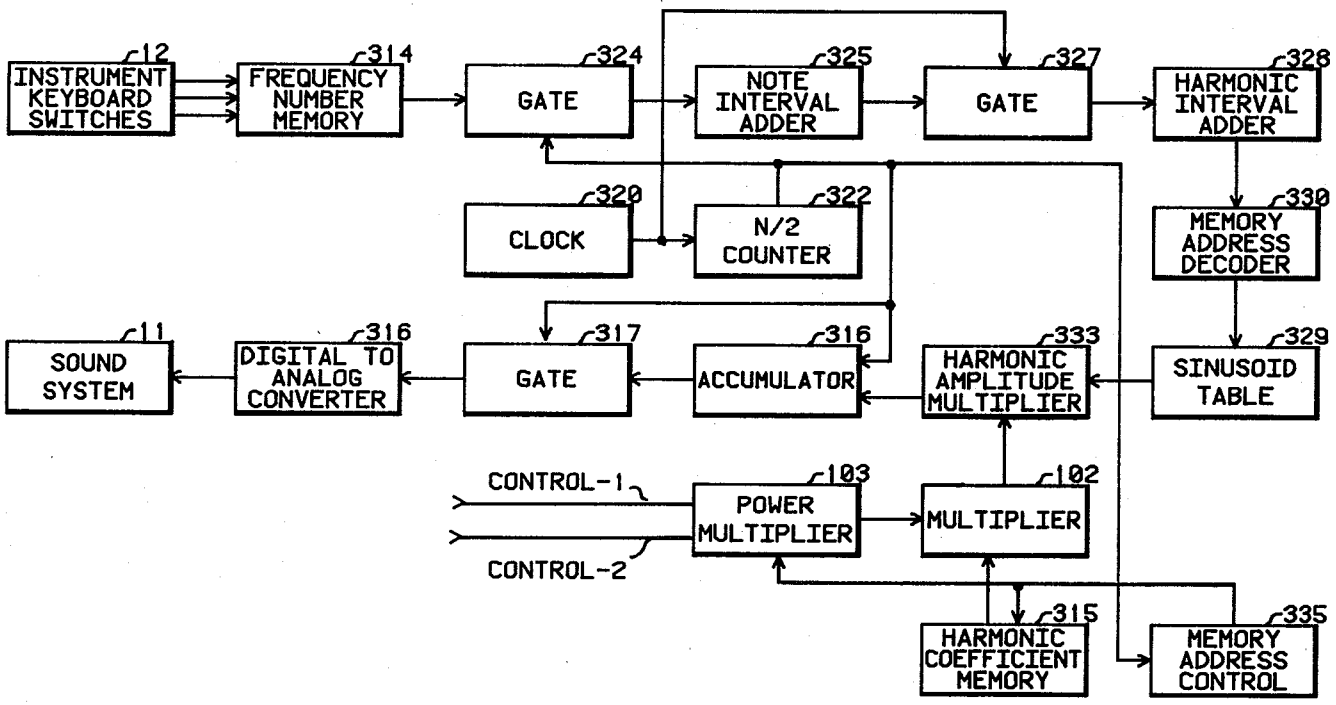
FIG. 5 is a schematic diagram of the inventive system incorporated into a Computor Organ.

The present invention can readily be incorporated into other musical tone generation systems which produce musical waveforms by computing a Fourier-like transformation using a set of harmonic coefficients. A system of this type is described in U.S. Pat. No. 3,809,786 entitled "Computer Organ." This patent is hereby incorporated by reference. The system blocks in FIG. 5 which have numbers in the "300" range are numbered to be 300 added to the block numbers shown in FIG. 1 of the referenced U.S. Pat. No. 3,809,786.

A closure of a keyswitch contained in the block labeled instrument keyboard switches 12 causes a corresponding frequency number to be accessed out of the frequency number memory 314. The frequency number transferred via gate 324 is repetitively added to the contents of the note interval adder 325 at a rate determined by the changes in the count state of the N/2 counter 322. The content of the note interval adder 324 specifies the sample point on a waveshape that is to be computed. For each such sample point, the amplitudes of a number of harmonic components are individually calculated by multiplying harmonic coefficients furnished by the multiplier 102 with trigonometric values read out of the sinusoid table 329. This multiplication is performed by the harmonic amplitude multiplier 333. The resultant harmonic component amplitudes are summed algebraically by means of the accumulator 316 to obtain the net amplitude at the waveshape sample point corresponding to the content of the note interval adder. The details of this calculation are described in the referenced U.S. Pat. No. 3,809,786.

The waveshape sample points contained in the accumulator 316 are converted into analog signals by means of the digital-to-analog converter 316. The output analog signal is furnished to the sound system 111 which transforms the signal into an audible musical tone.

While successive integrations and differentiations are most commonly evaluated for an integer order of integration and differentiation, there is no inherent limitation to the evaluation of Eq. 4 or Eq. 7 for integer values of the index k. An important variation of the present invention is to use what can be termed "fractional integration" and "fractional differentiation" of a waveshape that is computed from a given set of harmonic coefficient by means of a Fourier-type transformation algorithm. To implement fractional integration and fractional integration, the value of k appearing in Eq. 7 and Eq. 4 is changed from an integer value to a fractional, or decimal value. In the system implementation shown in the figures, and described previously, the computation of a fractional power of the harmonic coefficient is performed by the power multiplier 103. This computation is readily accomplished if the power multiplier 103 is implemented as a microprocessor. The software instructions for the microprocessor can readily be formulated to form a positive or negative fractional power of an input variable. Thus if q, the harmonic number, is the input, then the microprocessor is programmed to compute $q^k$. k can be either a positive or negative integer or non-integer value. Because of the previously cited insensitivity of the ear to Fourier signal component phases for periodic waveshapes, Eq. 4 and Eq. 7 can be used with only the first terms and the modulo pre-multipliers set to a unit value.

Figure 6:
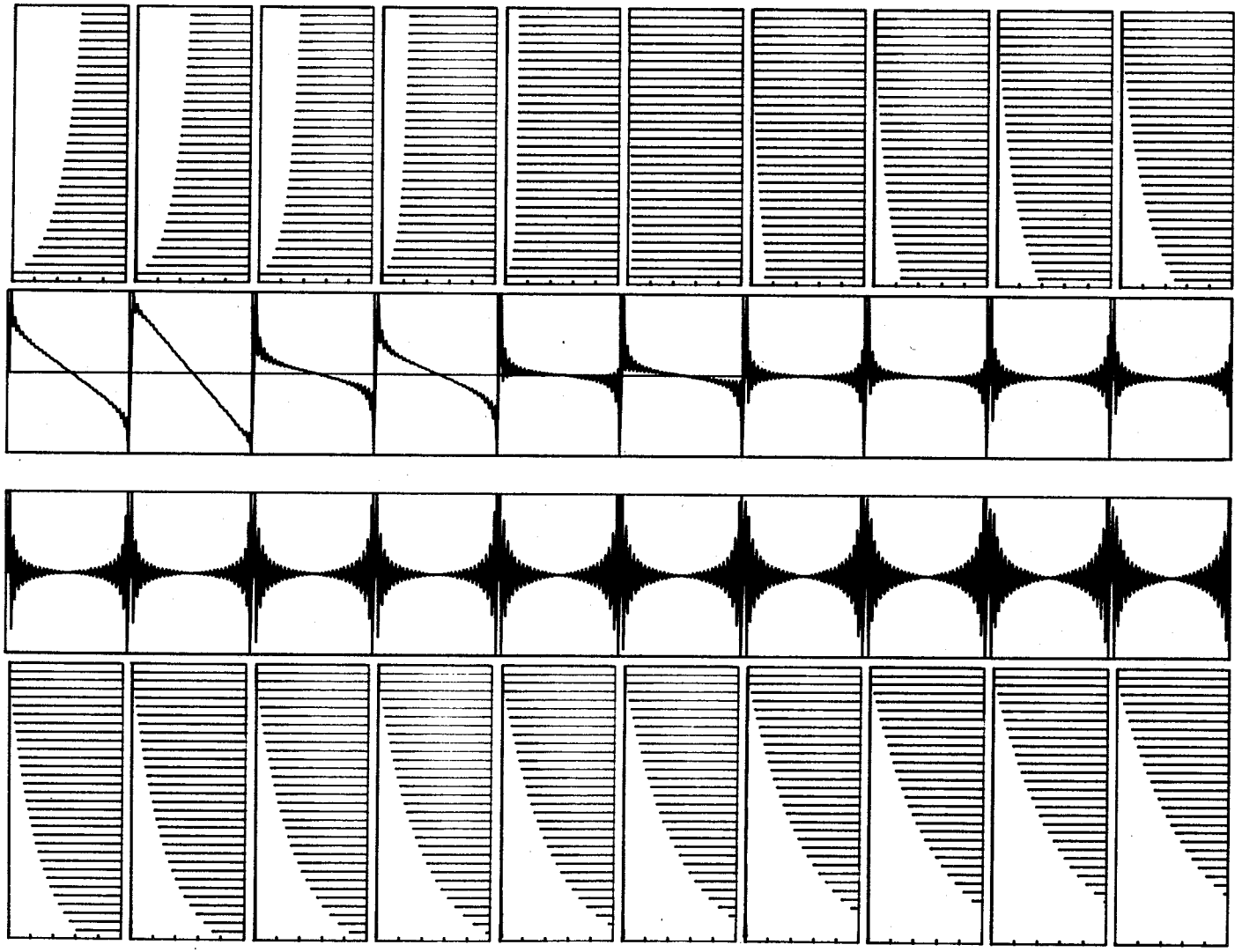
FIG. 6 is a set of spectra for fractional differentiation of a musical waveshape.

FIG. 6 is a set of curves obtained by a computer simulation of the system shown in FIG. 4. The stored harmonic coefficients in the harmonic coefficient memory 15 are those which correspond to a sawtooth waveshape. Each spectrum in the top row of spectra in FIG. 6 corresponds to the waveshape drawn immediately below it. Each spectrum in the bottom row of spectra corresponds to the waveshape drawn immediately above it. The top left spectrum and waveshape correspond to the waveshape with no differential. The spectra following in sequence were generated for a fractional differential having a value of $k=5(M-1)/20$ where M is a curve index number varying from $M=1$ to 10 on the top row of spectra and for $M=11$ to 20 on the bottom row of spectra. It is noted that an increasing value of k is similar to raising the cutoff frequency for a high-pass filter. The accentuation of higher frequencies is a characteristic attribute of waveshape differentiation.

Figure 7:
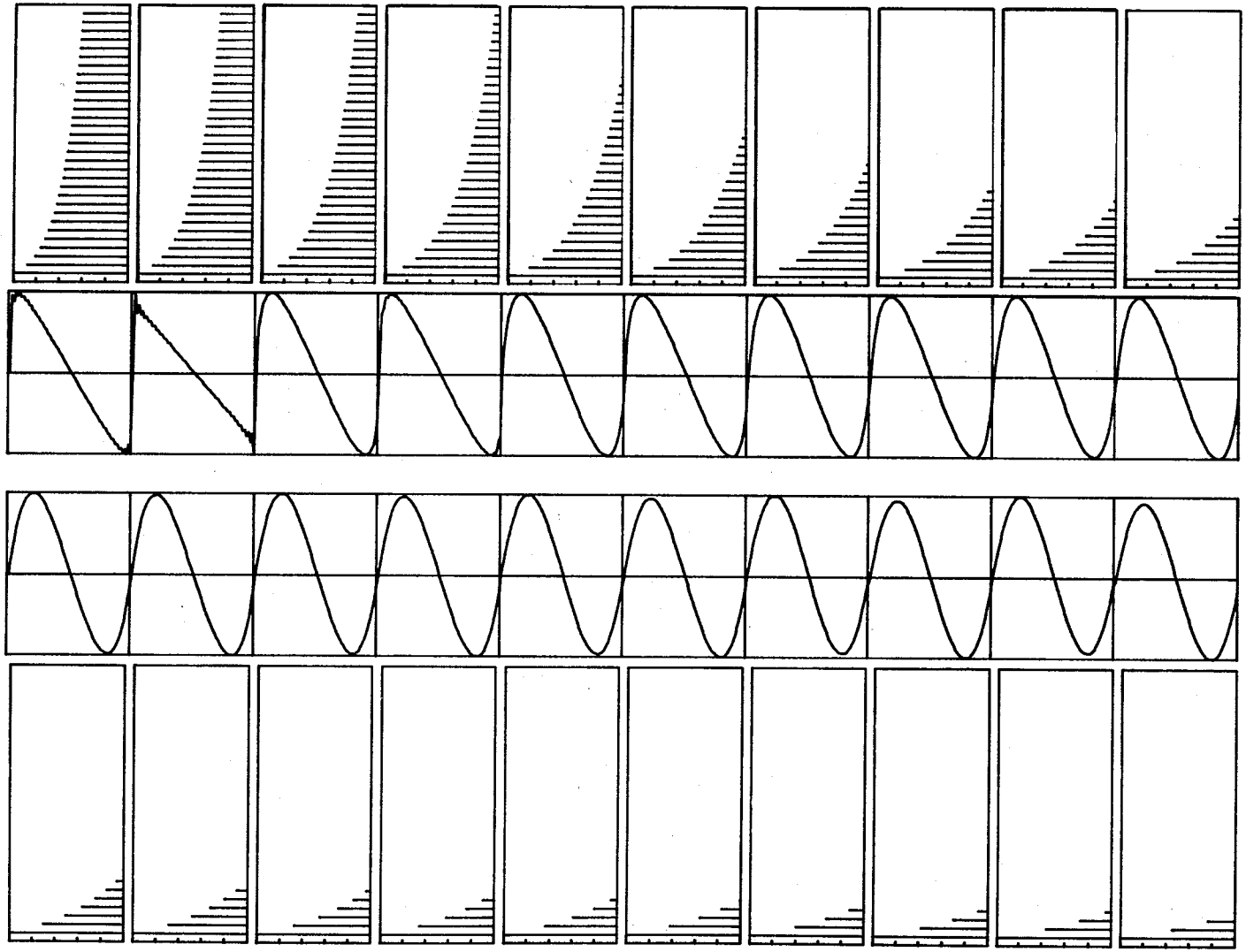
FIG. 7 is a set of spectra for fractional integration of a musical waveshape.

FIG. 7 shows a set of curves corresponding to fractional integration of a waveshape. The harmonic coefficients used in the system simulation were those for a sawtooth waveform which were used in the generation of the curves in FIG. 6. The integration index was selected as $k=5(M-1)/20$ which corresponds to the cases shown in FIG. 6. It is noted that an increasing value of k for a fractional integrator is similar to lowering the cutoff frequency of a low-pass filter. The accentuation of lower frequencies is a characteristic attribute of waveshape integration.

Figure 8:
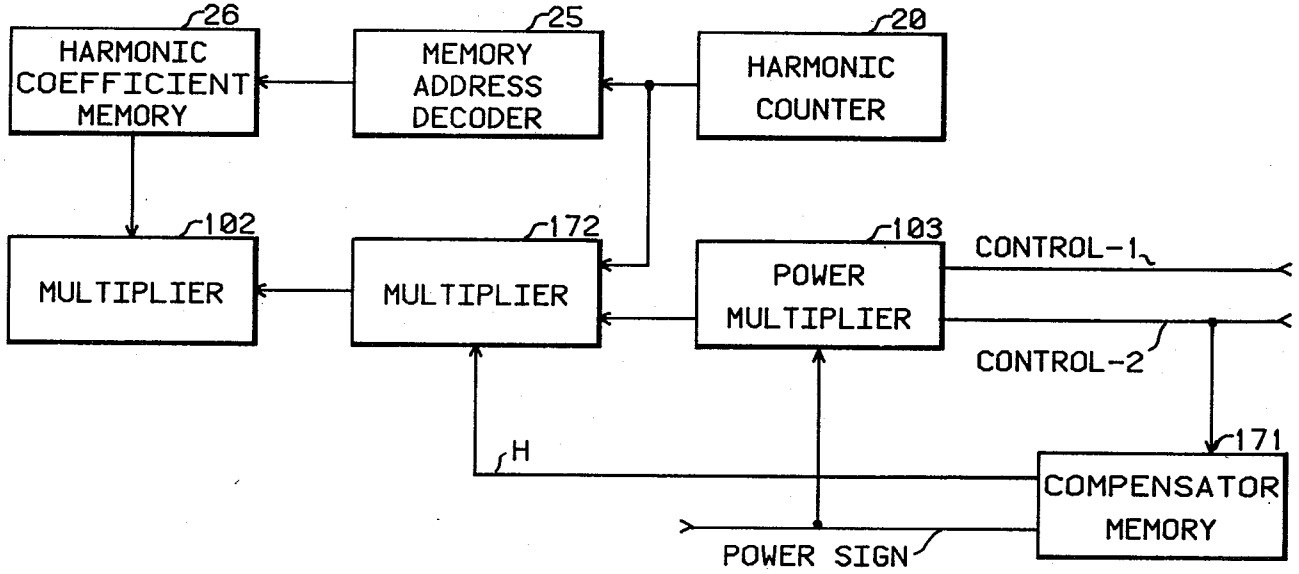
FIG. 8 is a schematic diagram of a level compensator.

The form of the inventive system described above does not maintain a constant loudness level of the various orders of differentiation and integration of a given waveform as determined by the harmonic coefficients stored in the harmonic coefficient memories. FIG. 8 shows an alternative embodiment in which a compensator is used to maintain the loudness level at nearly a constant as the order of differentiation or integration is varied.

In response to the CONTROL-2 signal a compensation variable H is addressed out from the compensator memory H. Since the CONTROL-2 signal determines the value of k, which is the integration or differentiation order, the value of H is essentially addressed out at a memory location corresponding to k. The compensator memory 171 is configured as two memories. One memory corresponds to a "1" logic state for the POWER SIGN signal and the second memory corresponds to a "0" logic state for the POWER SIGN signal. In this fashion a value of H is selected for either a waveshape differential or a waveshape integration.

The multiplier 172 multiplies the output signal from the power multiplier 103 by the value of H addressed out from the compensator memory 171. The scaled, or product, value from the multiplier 172 is furnished to the multiplier 102.

The values of H stored in the compensator memory 171 can be chosen experimentally by listening tests. These tests can determine the loudness variations which are desired for each of various orders of waveshape differentiation and integration.

Figure 9:
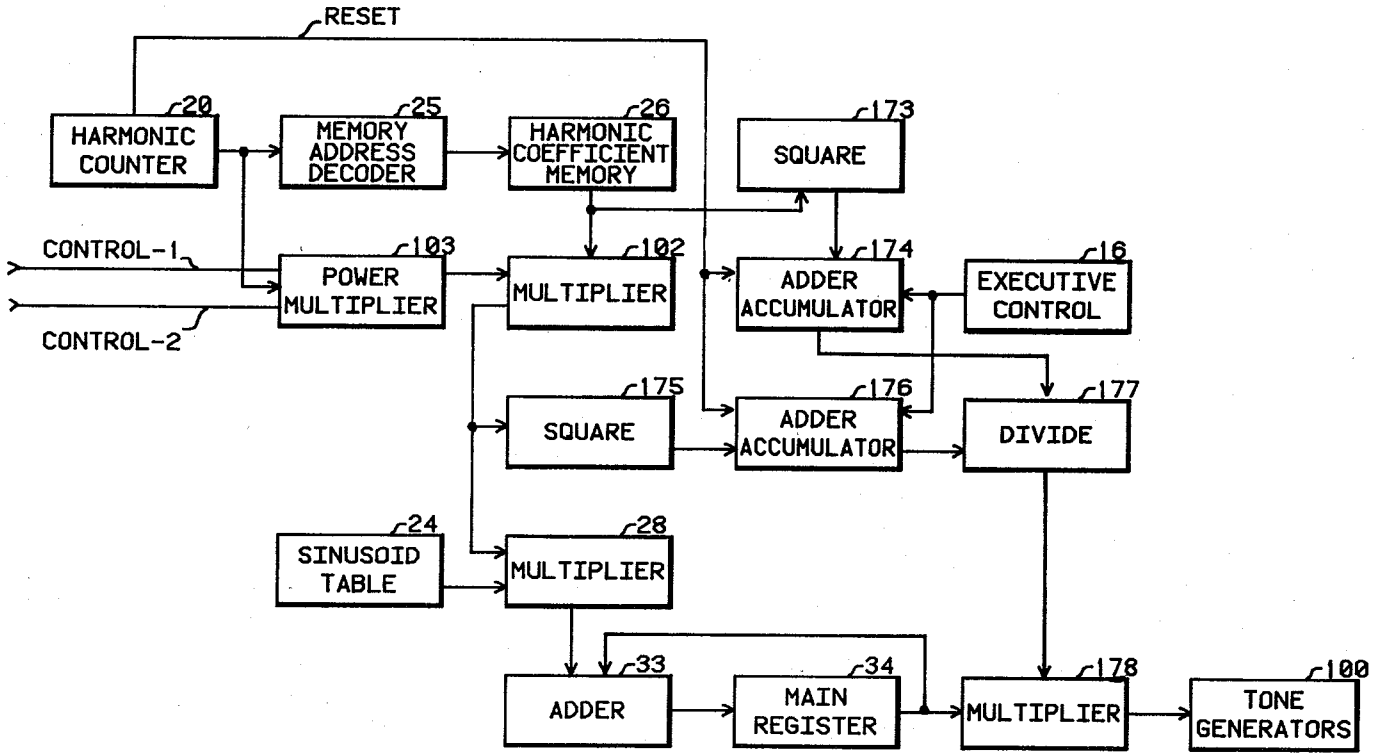
FIG. 9 is a schematic diagram of a total power compensator.

FIG. 9 shows a subsystem for maintaining the signal power of a waveshape at a constant level as the order of waveshape differentiation or integration is changed. For illustrative purposes the subsystem is shown for the system version shown in FIG. 4. This is not a limitation as the same subsystem is readily adaptable to all the various implementations of the inventive system.

At the start of a computation cycle, the executive control initializes the contents of the accumulators in the adder-accumulator 174 and the adder-accumulator 176. This is accomplished by using the same signal which initializes the accumulator in the adder-accumulator 21. As the harmonic coefficients are accessed from the harmonic coefficient memory 26 they are furnished to both the multiplier 102 and the square 173.

The square 173 multiplies an input harmonic coefficient value by itself and transfers the squared value to the adder-accumulator 174.

The adder-accumulator 174 adds each received squared value to the contents of an accumulator. The accumulator is reset to a zero value by a RESET value generated by the harmonic counter 20. This RESET signal is generated each time that the harmonic counter 20 returns to its initial count state because of its modulo counting implementation. At the end of a computation cycle the content of the adder-accumulator 174 will be a value corresponding to the total power associated with the set of harmonic coefficients read out of the harmonic coefficient memory 26.

The output data values from the multiplier 102 are furnished to both the square 175 and the multiplier 28. The action of the multiplier 28 and its associated logic blocks produces the master data set values which reside in the main register 34 at the completion of each computation cycle in a sequence of computation cycles.

The square 175 multiplies the output data value received from the multiplier 102 by itself and transfers the squared value to the adder-accumulator 176. The adder-accumulator 176 adds each received squared value to the contents of an accumulator. The accumulator is reset to a zero value by the RESET signal generated by the harmonic counter 20. At the end of a computation cycle the content of the adder-accumulator 176 will be a value corresponding to the total power associated with either a differentiated or integrated waveform corresponding to the original set of harmonic coefficients stored in the harmonic coefficient memory 26.

The content of the adder-accumulator 174 is divided by the content of the adder-accumulator 176 by means of the divide 177. The quotient obtained at the end of a computation cycle represents a ratio of total powers. The quotient is transferred to the multiplier 178. The multiplier multiplies each of the master data set values as they are transferred to the tone generators 100 during a transfer cycle. The net result is that the master data set values transferred to a tone generator represent a waveshape having a constant power level which is independent of a selected order of waveshape differentiation or integration.

I claim:

1. In combination with a musical instrument in which musical waveshape data points are computed during each one of a sequence of computation cycles from a set of harmonic coefficients, apparatus for producing derived musical tones comprising;

a harmonic coefficient memory for storing said set of harmonic coefficients, a memory address generating means for generating a sequence of memory address numbers, a memory addressing means for reading out a harmonic coefficient from said harmonic coefficient memory in response to each one of said sequence of memory address numbers, a control signal generator wherein a scale control signal is generated in response to a preselected order signal, a power multiplier means whereby a sequence of scale numbers are created each of which has a numerical magnitude corresponding to an associated one of said sequence of memory address numbers raised to a power associated with said scale control signal, a scale multiplier means whereby each harmonic coefficient read out of said harmonic coefficient memory is multiplied by a corresponding one of said sequence of scale numbers to create a sequence of scaled harmonic coefficients, a waveshape memory means, a means for computing responsive to said sequence of scaled harmonic coefficients whereby said musical waveshape data points are computed and stored in said waveshape memory means, a waveshape reading means whereby said waveshape data points are sequentially and repetitively read out of said waveshape memory means, and a means for producing musical tones responsive to waveshape data points read out from said waveshape memory means whereby said derived musical tones are produced.

2. In a musical instrument according to claim 1 wherein said control signal generator comprises;

a power sign signal generator responsive to a preselected power signal whereby a positive sign signal is generated if said power signal has a positive numerical value and whereby a negative sign signal is generated is said power signal has a zero numerical value.

3. In a musical instrument according to claim 2 wherein said power multiplier means comprises;

a power computing means whereby said sequence of scale numbers are created each of which has a numerical magnitude corresponding to an associated one of said sequence of memory address numbers raised to a positive power associated with said scale control signal if said positive signal is generated and whereby said sequence of scale numbers are created each of which has a numerical magnitude corresponding to an associated one of said sequence of memory address numbers raised to a negative power associated with said scale control signal if said negative sign signal is generated.

4. In a musical instrument according to claim 2 wherein said power multiplier means comprises;

a positive power memory containing a set of positive power numbers, a negative power memory containing a set of negative power numbers, a second memory addressing means for simultaneously reading positive power numbers from said positive power memory and negative power numbers from said negative power memory in response to said preselected power signal, a data select means whereby positive power numbers read out from said positive power memory are selected if said positive sign signal is generated and whereby negative power numbers read out from said negative power memory are selected if said negative sign signal is generated, and a power computing means whereby said sequence of scale numbers are created each of which has a numerical magnitude corresponding to an associate one of said sequence of memory address numbers raised to a power corresponding to the numbers selected by said data select means.

5. In a musical instrument according to claim 1 wherein said memory address generating means comprises;

a logic clock means for providing logic timing signals, a word counter for counting said logic timing signals modulo two times the number of harmonic coefficients stored in said harmonic coefficient memory, and a harmonic counter incremented each time said word counter returns to its minimal count state wherein the count states of said harmonic counter constitute said sequence of memory address numbers and whereby said harmonic counter counts modulo the number of harmonic coefficients stored in said harmonic coefficient memory.

6. In a musical instrument according to claim 5 wherein said means for computing comprises;

a computer adder-accumulator means wherein the count state of said harmonic counter is successively added to the content of an accumulator in response to said logic timing signals and wherein the content of said accumulator is initialized to a zero value at the start of each one of said sequence of computation cycles, a sinusoid table storing a set of trigonometric function values, a sinusoid table addressing means responsive to the content of said computer adder-accumulator means for reading out a trigonometric function value from said sinusoid table, a harmonic multiplying means whereby said trigonometric function value read out from said sinusoid table is multiplied by one of said sequence of scaled harmonic coefficients to form an output product value, and a summing means whereby said output product value is added to a data word read out of said waveshape memory means and whereby the summed value is stored in said waveshape memory means at an address corresponding to the count state of said word counter.

7. In a musical instrument according to claim 1 wherein said scale multiplier means comprises;

a compensator memory for storing a set of loudness scaling coefficients, a compensator memory adding means for reading out a loudness scaling coefficient from said compensator memory in response to said control signal, and a compensator multiplier wherein each one of said sequence of scale numbers is multiplied by a loudness coefficient read out of said compensator memory.

8. In a musical instrument according to claim 5 wherein said means for computing comprises;

a first squaring means whereby each harmonic coefficient read out from said harmonic coefficient memory is multiplied by itself to generate a squared harmonic coefficient, a first adder-accumulator means wherein each said generated squared harmonic coefficient is added to the content of an accumulator and wherein the content of said accumulator is initialized to a zero value each time said harmonic counter returns to its minimal count state, a second squaring means whereby each one of said sequence of scaled harmonic coefficients is multiplied by itself to generate a squared scaled harmonic coefficient, a second adder-accumulator means wherein each said squared scaled harmonic coefficient is added to the content of an accumulator and wherein the content of said accumulator is initialized in a zero value each time said harmonic counter returns to its minimal count state, a division means whereby the content of said first adder-accumulator means is divided by the content of said second adder-accumulator means to form a normalized loudness scale factor, and a loudness multiplier interposed between said waveshape memory and said means for producing musical tones wherein each waveshape data point read out from said waveshape memory is multiplied by said normalized loudness scale factor.

9. In a musical instrument according to claim 5 wherein said means for computing comprises;

a first power computing means for computing a first power number in response to harmonic coefficients read out of said harmonic coefficient memory and wherein said first power number corresponds to the total power associated with said set of harmonic coefficients, a second power computing means for computing a second power number in response to said sequence of scaled harmonic coefficients and wherein said second power number corresponds to the total power associated with said sequence of scaled harmonic coefficients, a division means for dividing said first power number by said second power number to form a normalized loudness scale factor, and a loudness multiplier interposed between said waveshape memory and said means for producing musical tones wherein each waveshape data point read out from said waveshape memory is multiplied by said normalized loudness scale factor.

10. In combination with a musical instrument in which musical waveshape data points are computed from a set of harmonic coefficients, apparatus for producing a selected differential of a waveshape comprising;

a harmonic coefficient memory for storing said set of harmonic coefficients each of which corresponds to a harmonic number, a memory addressing means for reading out harmonic coefficients from said harmonic coefficient memory, a scale control signal generator wherein a differentiation number is generated in response to a preselected order of differentiation, a scale multiplier means whereby each harmonic coefficient read out of said harmonic coefficient memory is multiplied by its corresponding harmonic number numerically raised to a power corresponding to said differentiation number to form a scaled harmonic coefficient, a computing means responsive to each said scaled harmonic coefficient whereby said waveshape data points are computed which correspond to a waveshape which is a derivative of a waveshape associated with a zero order of differentiation, and a means for producing musical tones responsive to said computed waveshape data points.

11. In combination with a musical instrument in which musical waveshapes are computed from a set of harmonic coefficients, apparatus for producing a selected integral of a waveshape comprising;

a harmonic coefficient memory for storing said set of harmonic coefficients each of which corresponds to a harmonic number, a memory addressing means for reading out harmonic coefficients from said harmonic coefficient memory, a scale control signal generator wherein an integral number is generated in response to a preselected order of integration, a scale multiplier means whereby each harmonic coefficient read out of said harmonic coefficient memory is divided by its corresponding harmonic number raised to a power corresponding to said integral number to form a scaled harmonic coefficient, a computing means responsive to each said scaled harmonic coefficient whereby said waveshape data points are computed which correspond to a waveshape which is an integral of a waveshape associated with a zero order of integration, and a means for producing musical tones responsive to said computed waveshape data points.

* * * * *